US007351167B1

(12) United States Patent
Hathaway

(10) Patent No.: US 7,351,167 B1
(45) Date of Patent: Apr. 1, 2008

(54) BASEBALL BAT TRAINING AID AND METHOD OF USE

(76) Inventor: Richard Hathaway, 305 Miami #5, Greenville, OH (US) 45331

( * ) Notice: Subject to any disclaimer, the term of this patent is extended or adjusted under 35 U.S.C. 154(b) by 67 days.

(21) Appl. No.: 11/307,631

(22) Filed: Feb. 15, 2006

Related U.S. Application Data

(63) Continuation-in-part of application No. 10/857,135, filed on Aug. 23, 2004, now abandoned.

(51) Int. Cl.
*A63B 69/00* (2006.01)
*A63B 59/06* (2006.01)

(52) U.S. Cl. ..... 473/457; 473/568

(58) Field of Classification Search ..... 473/457, 473/519, 520, 564–568, 30–303
See application file for complete search history.

(56) References Cited

U.S. PATENT DOCUMENTS

| | | | |
|---|---|---|---|
| 2,091,458 | A | 8/1937 | Sleight |
| 2,984,486 | A | 5/1961 | Jones |
| 3,104,876 | A | 9/1963 | Salsinger |
| 3,968,965 | A | 7/1976 | Frenkel et al. |
| 4,854,596 | A | 8/1989 | Carbonetti |
| 5,088,733 | A | 2/1992 | Barnea et al. |
| 5,169,145 | A | 12/1992 | Jang |
| 5,184,815 | A | 2/1993 | Maddox |
| 5,482,270 | A | 1/1996 | Smith |
| 5,577,722 | A | 11/1996 | Glassberg |
| 5,806,091 | A | 9/1998 | McHugh |
| 5,816,961 | A | 10/1998 | Kraemer |
| 5,839,983 | A | 11/1998 | Kramer |
| 5,867,868 | A | 2/1999 | Ward |
| 2003/0013563 | A1 | 1/2003 | Ryan |

FOREIGN PATENT DOCUMENTS

| | | |
|---|---|---|
| GB | 9232 | 4/1913 |

*Primary Examiner*—Mark S Graham
(74) *Attorney, Agent, or Firm*—R. William Graham

(57) ABSTRACT

A training aid for a baseball bat includes an outer portion and an inner core portion which is relatively rigid with respect to the outer portion, the aid is for placement against a bat handle having an arched outer surface which is of a size to extend along inside middle knuckles of one's fingers for purposes of providing knuckle alignment while permitting a substantial portion of one's fingers free to grip the bat handle to provide a tactile sensation of gripping the bat principally with one's fingers and not one's palms and, which when so gripped by a batter, the training aid provides knuckle alignment for each hand and promotes anatomical superior fluidity of motion in one's hands, wrists and arms during a swing.

15 Claims, 4 Drawing Sheets

BASEBALL BAT TRAINING AID AND METHOD OF USE

This is a continuation-in-part of U.S. Ser. No. 10/857,135 filed Aug. 23, 2004.

BACKGROUND OF THE INVENTION

1. Field of the Invention

This invention relates to a training aid for gripping a baseball bat or the like for developing proper gripping.

2. Description of the Prior Art

There exist a myriad of aids for baseball bats. Of those pertaining to aiding in the grip for a baseball player, there are devices which wrap around the handle and have a raised surface portion which is used to align the hands. For example, one such aid provides a bat grip that includes upper and lower separated segments that wrap completely around the bat handle and allow for use of both hands independently by either a left handed or right handed player and has raised surface portion for knuckle alignment. The focus of that invention is to provide the batter with a better gripping surface and hand alignment. That aid, however, provides an artificial feeling with respect to the actual bat handle and does not accustom the player to the feel of the bat with the aid and thus teaches incorrect muscle memory.

Another type of aid includes gloves which have visual alignment markings on the outside of the finger portions. While such aid provides for a proper set up, it does not aid in retaining the hand alignment during a swing and thus does not promote muscle memory.

There is a need to improve the bat training aids to overcome the problems mentioned. The present invention overcomes these problems.

SUMMARY OF THE INVENTION

It is an object to develop the proper anatomical grip of the bat using primarily the fingers of the hands and not the palms of the hands.

It is an object to improve one's grip of a bat.

It is another object of this invention to provide a teaching aid which aligns one's knuckles in a manner to provide a proper grip of the bat.

It is still another object of this invention is to provide a training aid which can be used for right and left handed players.

Another object of the invention is to provide an adjustable training aid to permit some personal preference in knuckle alignment of both hands.

Accordingly, the invention is directed to a training aid which can be extruded, molded or otherwise formed. The training aid is elongated and is characterized in cross section to include an arch with an arched bottom surface complementary and for connection to a bat handle and an arched outer surface which is of a size to extend along inside middle knuckles of one's fingers for purposes of providing knuckle alignment while permitting a substantial portion of one's fingers free to grip the bat handle. By so doing, the trainee has the tactile sensation of holding the bat with the ends of the hands in the fingers and not back in the palms which provides maximum fluidity of movement in the hands, wrists and arms during the swinging motion. The aid can be cut to a length sufficient to extend along the handle of the bat such that both hands' fingers can grip the aid, i.e., approximate the width of two hands side by side. The training aid can include an outer portion and an inner core portion. In one embodiment, the outer portion is flexible relative to the inner core portion. The outer portion includes an arcuate bottom surface which is configured complementary to fit against a portion of the handle. The outer portion can be of a translucent material and the inner portion of an opaque material, which can be pigmented with a unique color to indicate a particular size of training aid. Alternatively, the aid can be two pieces wherein each piece can be a length to extend approximately the width of one hand and can be interconnected by a post within coaxial post holes extending inward from an end of each aid. The training aid can also be adjusted on the bat relative to the individual's preference.

The two aids allow adjustment and positioning of each hand individually for knuckle alignment and maximum wrist flexibility during the swing based on a particular batter preference. A left handed or right handed batter can use the aid through the interconnection provided.

Also provided is a method of training a proper grip of a bat handle. The method includes the steps of employing an elongated member having a cross section including an arch of substantially same dimension throughout a longitudinal length of said member with an arched bottom surface complementary and for connection to a circumferential portion of the bat handle in a non-self retaining manner on the handle and has an arched outer surface which is of a size to extend along inside middle knuckles of one's fingers for purposes of providing knuckle alignment while permitting a substantial portion of one's fingers free to grip the bat handle and to provide a tactile sensation of gripping the bat principally with one's fingers and not one's palms and, which when so gripped by a batter, said training aid provides knuckle alignment for each hand and promotes anatomical superior fluidity of motion in one's hands, wrists and arms during a swing, disposing said member onto the bat handle, and gripping about said member and the handle in a manner such that one's knuckles are disposed over said arched outer surface.

In accordance with these and other objects which will be apparent hereinafter, the instant invention will now be described with particular reference to the accompanying drawings.

DESCRIPTION OF THE PREFERRED EMBODIMENTS

Figure 10:
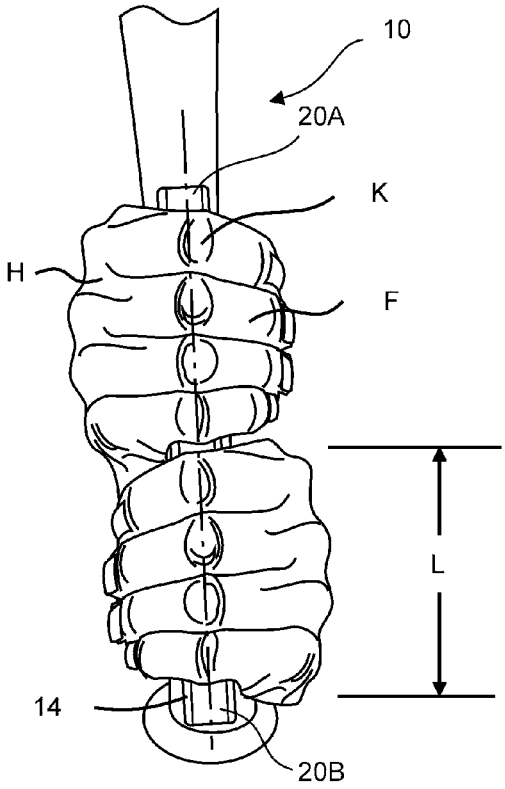
FIG. 10 illustrates a perspective view of the first mode of operation on a bat handle.

Referring now to the drawings, a baseball bat training aid of the present invention is generally designated by the numeral 10. The baseball bat training aid 10 is for use on a bat 12 to aid in developing proper knuckle alignment as seen in FIG. 10, for example, and in turn muscle memory of a batter.

Unlike other alignment aids heretofore, the baseball bat training aid 10 is intended for temporary disposal adjacent a handle 14 of the bat 12 so that the baseball bat training aid 10 is substantially only disposed beneath the middle knuckles K of the hand H for purposes of aligning the knuckles K while permitting the remaining portion of one's fingers F to substantially grip the handle H. The size of the training aid 10 should not be so large as to preclude the remainder of fingers F to grip and hold onto the handle 14. Thus, the training aid 10 enables a batter to effectively simulate a more accurate or true feeling of the bat 12 handle 14 when the baseball bat training aid 10 is removed for actual play.

The trainee learns to grip the bat 12 with the ends of the hands by gripping with fingers F and not holding onto the bat in the palms of the hands. The middle knuckles K are used as a hinge point as the fingers F squeeze the grip the handle 14. This finger gripping method is believed to improve the anatomical motion of the hands, wrists and arms, thus improving the entire motion of swinging the bat 12.

The baseball bat training aid 10 can preferably include a pair of elongated members 16A and 16B each comprised of an outer portion 17A and 17B, respectively and an inner core portion 19A and 19B, respectively, which preferably runs the length members 16A and 16B. The outer portions 17A and 17B each include an arcuate bottom surface 18A and 18B, respectively, and is mad of a relatively more pliable material than the inner portions 19A and 19B, respectively, such that edges 21A and 21B, can flex slightly to adjust to the contour of the bat handle 14 and aid in achieving a complementary fit of the arcuate bottom surface 18A and 18B against a portion of the handle 14. In addition, the outer portions 17A and 17B can be made of a translucent material and the inner portions 19A and 19B serve as a core which can be relatively rigid material and can be opaque. Preferably, the inner core portions 19A and 19B can be pigmented with a unique and different color which corresponds to a particular sized training aid 10 which can vary as discussed hereinafter. In this regard, the player can quickly and easily identify the size desired.

Figure 8:
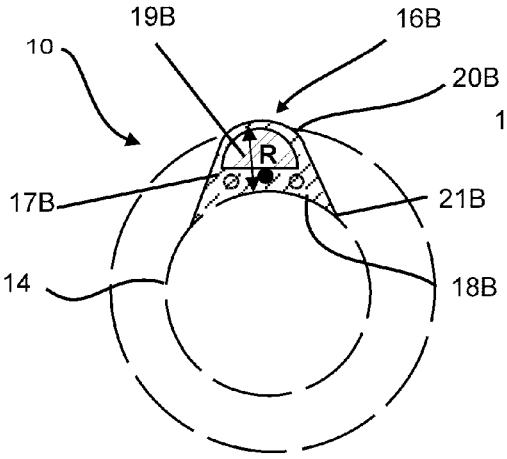
FIG. 8 illustrates a cross sectional view through line 8-8 of FIG. 6 of the first mode of operation on a bat handle.

As seen in FIG. 8, for example, cross section of the training aid 10 on the handle 14 simulates the shape of an axe handle. It is understood that bat handles vary in diameter with typical ranges from ¾ inch to 1 inch diameters. The elongated members 16A and 16B each include an arcuate top surface 20A and 20B, respectively, which is configured of a radial size R to fit substantially beneath the area of the middle knuckles K in a manner to provide surface support for easy and proper alignment of the knuckles K. As seen in FIGS. 8-11, the cross-sectional radial size R should readily permit the fingers F to otherwise grip the handle 14 in a conventional manner. Each elongated member 16A and 16B should preferably be of a length L which is approximate the width of one's hand to provide a continuous alignment surface each hands knuckles K.

It is contemplated that the members 16A and 16B could be a connected integrally or by way of a connecting rod 22. In the case of the connecting rod 22, each of the connecting members 16A and 16B can include one or more rod receiving surfaces 24A and 24B, respectively, which extend axially inward from ends 26A and 26B and can preferably be equidistantly spaced from one another along the arcuate bottom surfaces 18A and 18B.

Figure 2A:
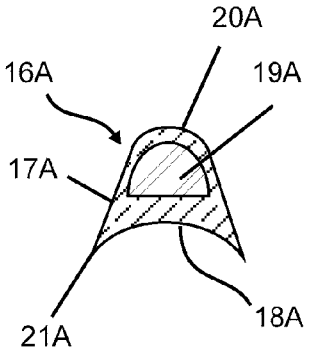
FIG. 2A is an end view of an embodiment of a part of the present invention.
Figure 3:
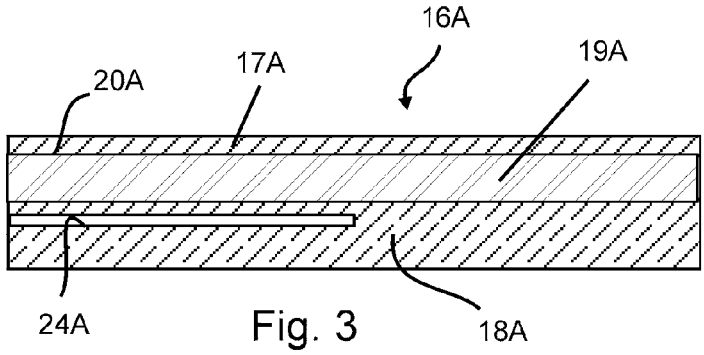
FIG. 3 shows a cross section through line 3-3 of FIG. 2B.
Figure 4:
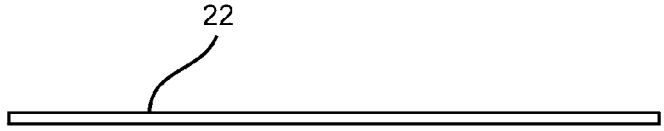
FIG. 4 shows a side view of connecting rod of the invention.
Figure 2B:
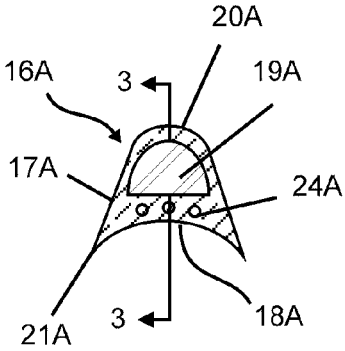
FIG. 2B is an end view of another embodiment of a part of another embodiment of the invention.
Figure 1:
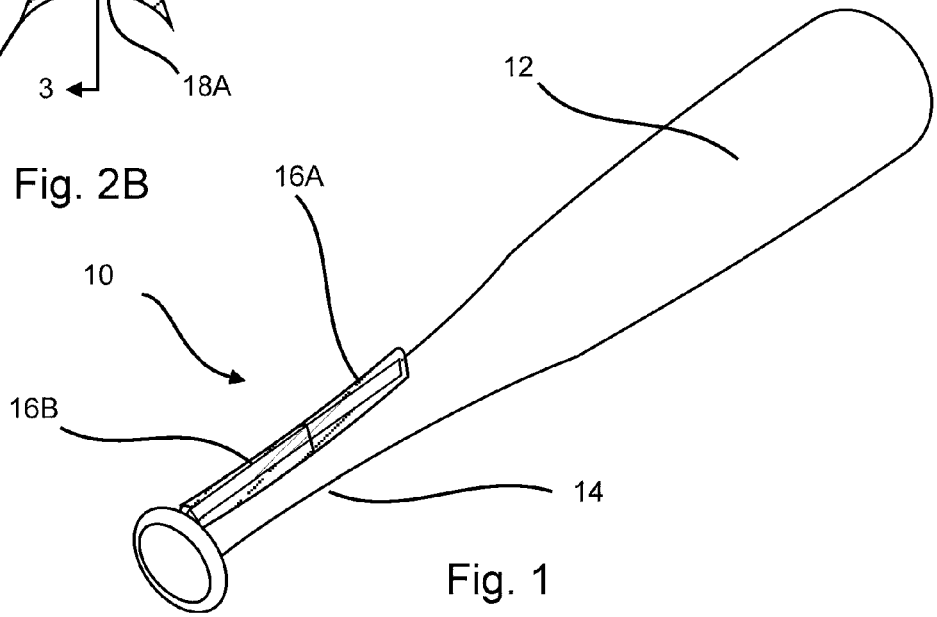
FIG. 1 shows a perspective view of the present invention on a baseball bat.
Figure 5:
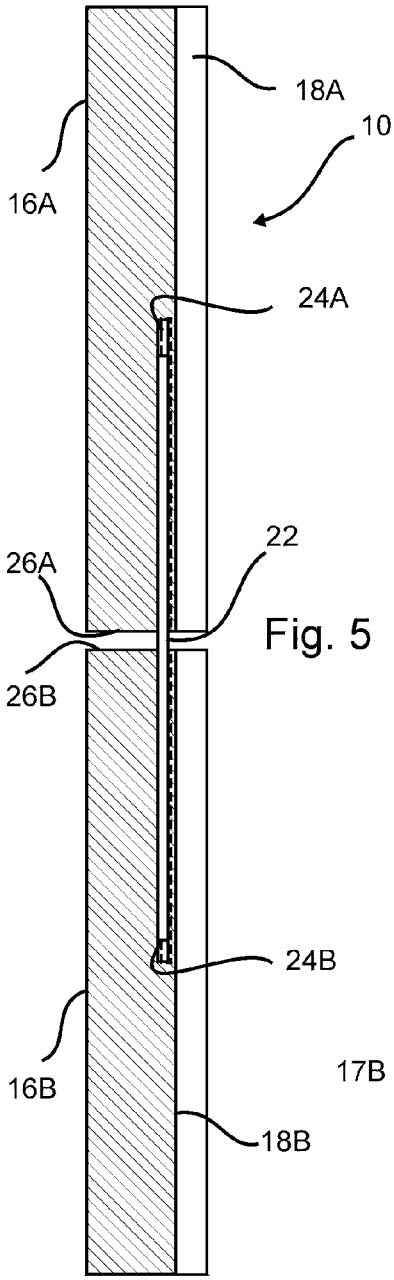
FIG. 5 shows a longitudinal part section of the present invention.
Figure 6:
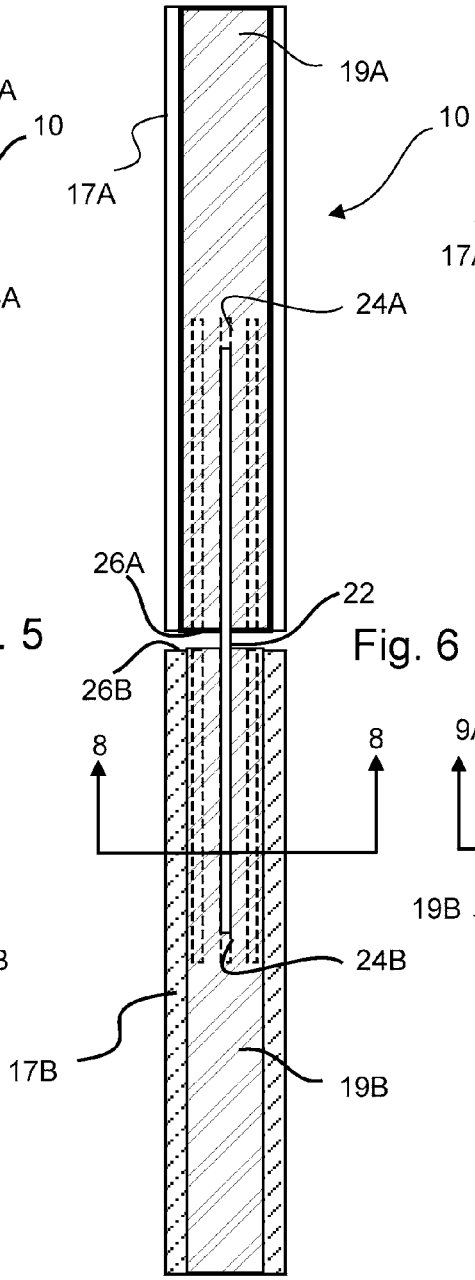
FIG. 6 illustrates a top plan view of the invention in a first mode.
Figure 7:
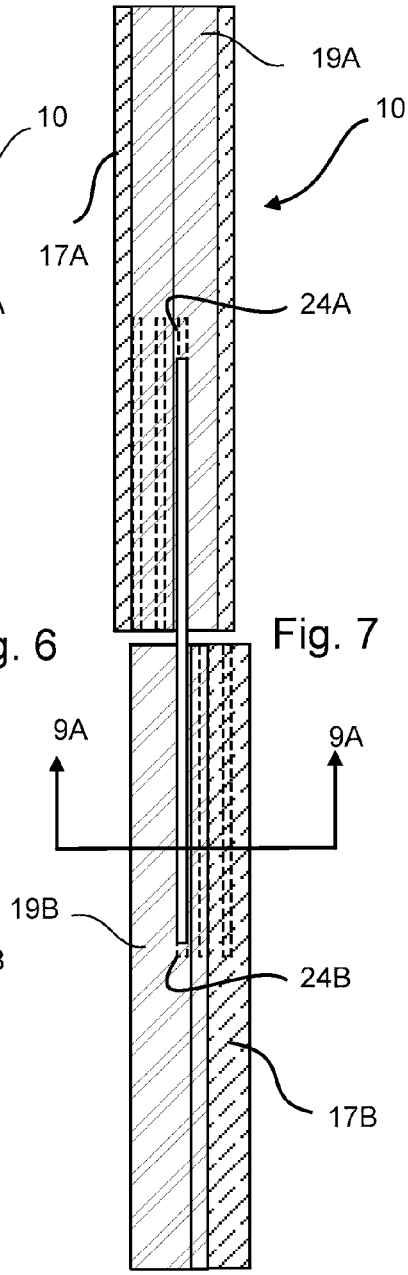
FIG. 7 illustrates a bottom view of the invention in a second mode.
Figure 11:
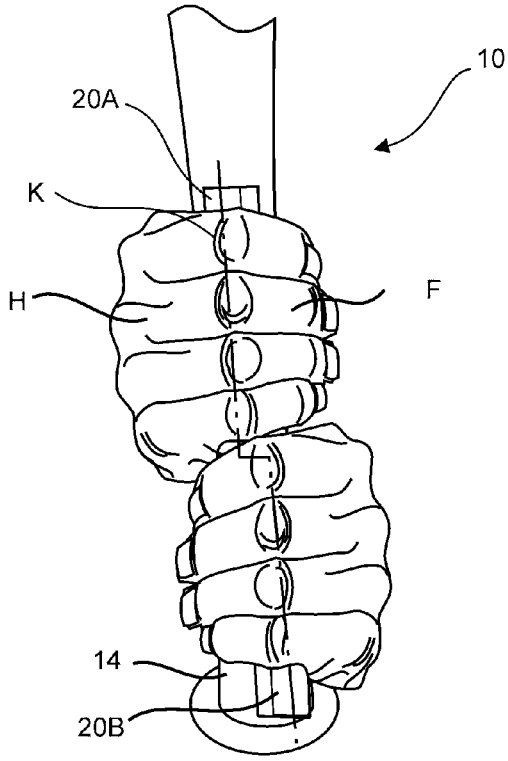
FIG. 11 illustrates a perspective view of the second mode of operation on a bat handle.
Figure 9A:
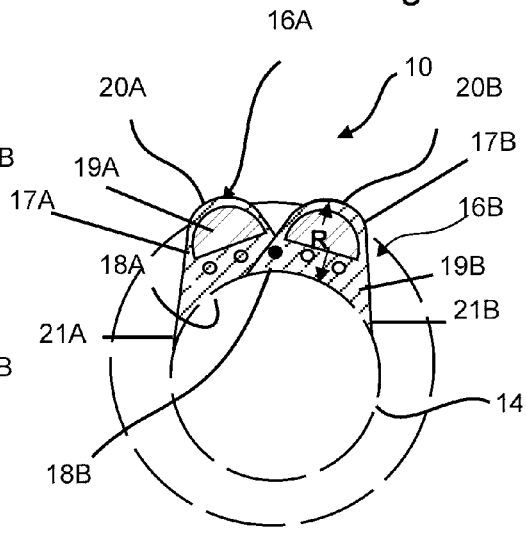
FIG. 9A illustrates a cross sectional view through line 9A-9A of FIG. 7 of the second mode of operation on a bat handle.

Here there are shown three rod receiving surfaces 24A and 24B in ends 26A and 26B, respectively. This provides for alternative alignments to be achieved for both right and left handed players. FIGS. 1, 6, 8 and 10 illustrate alignment of central rod receiving surfaces 24A and 24B wherein the rod 22 is disposed therein to interconnect the members 16A and 16B. Thus, when placed on the handle 14 as seen in FIG. 10, the knuckles K of both hands are aligned. FIGS. 7, 9A and 11 illustrate alignment opposite end rod receiving surfaces 24A and 24B wherein the rod 22 is disposed therein to interconnect the members 16A and 16B. Thus, when placed on the handle 14 as seen in FIG. 11, the knuckles K of both hands are parallel but out of alignment. It is thought that proper alignment of the knuckles K should be as is seen in FIG. 10.

Figure 9B:
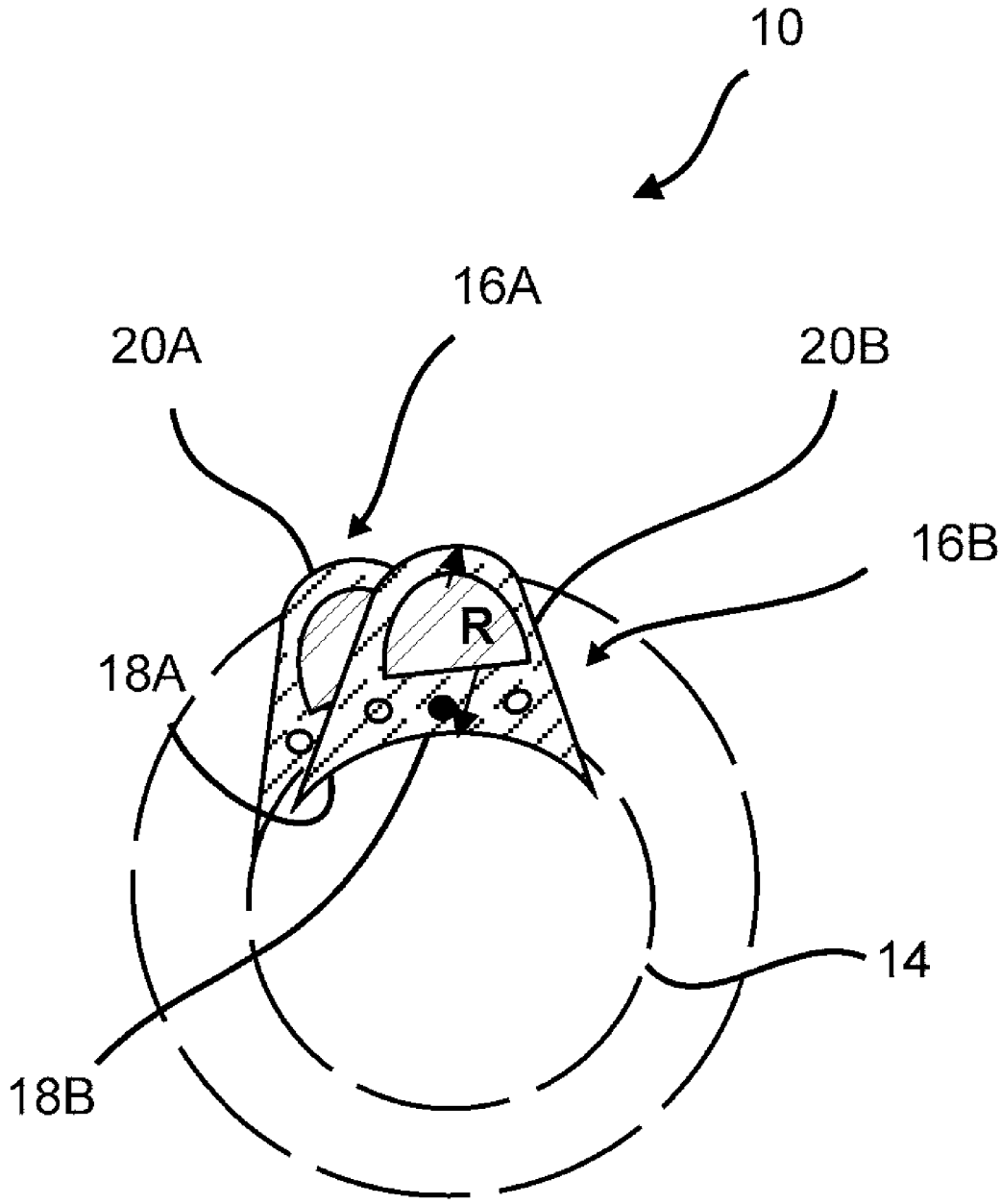
FIG. 9B illustrates another cross sectional view in a third mode of operation on a bat handle.

Alignment as in FIG. 10 may be too uncomfortable of a change for a well developed player having a history of severely palm gripping the bat 12. Thus, a player can set the training aid 10 to a more comfortable position as seen in FIG. 11 and work towards obtaining the proper alignment as seen in FIG. 10. FIG. 9B shows an intermediate staggered alignment wherein rod 22 interconnects a middle rod receiving surface 24A of member 16A with end rod receiving surface 24B of member 16B. The various rod receiving surface 24A and 24B positions affect alignment which can be used as intermediate steps for the player to change as described above.

It is further contemplated that the baseball bat training aid 10 can be made of sizes and lengths to accommodate children and adults, but the basic premise and operation of the invention would still apply. For example, the radial size R for an adult can be on the order of 9/16 inch and smaller, while for a junior player on the order of ¼ inch and larger (i.e., big enough for alignment without making it so large in diameter that it is impractical for the remainder of the hand to properly simulate a normal grip of the handle 14 when the aid 10 is removed thereby providing accurate muscle memory). Typical materials for each of the portions hereinabove described for the baseball bat training aid 10 can include plastic, vinyl, rubber, metal, for example, so long as it lends itself to the function of the particular portion herein described. The training aid 10 can be temporarily or permanently attached to bat 12 by various attachment means, such as tape or adhesive, for example, or it can be freely held between the fingers F and the bat 12. The training aid 10 can be attached by way of tape, Velcro, adhesive or the like or simply held against the handle with the Fingers F.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A training aid for aiding in training proper grip of a bat handle, which includes:

an elongated member including an outer portion and an inner core portion which is rigid with respect to said outer portion, said member is characterized in cross section to include an arch of substantially same dimension throughout a longitudinal length of said member with an arched bottom surface complementary and for connection to a circumferential portion of the bat handle in a non-self retaining manner on the handle and has an arched outer surface which is of a size to extend along inside middle knuckles of one's fingers for purposes of providing knuckle alignment while permitting a substantial portion of one's fingers free to grip the bat handle and to provide a tactile sensation of gripping the bat principally with one's fingers and not one's palms and, which when so gripped by a batter, said training aid provides knuckle alignment for each hand and promotes anatomical superior fluidity of motion in one's hands, wrists and arms during a swing, wherein said outer portion is a generally translucent material and said inner core portion is opaque.

2. The training aid of claim 1, wherein said inner core is a particular color denoting a particular size of training aid.

3. The training aid of claim 1, wherein said aid includes two elongated members which are removably interconnected to permit end to end placement on the bat relative to the individual's preference.

4. The training aid of claim 1, wherein said aid is of a length approximate the width of two hands side by side to extend along the handle of the bat such that both hands' fingers can grip said aid.

5. The training aid of claim 1, wherein said aid includes two said elongated members, wherein each said elongated member is of a length approximate the width of one hand to extend along the handle of the bat such that each hands' fingers can grip each respective said elongated member.

6. The training aid of claim 5, wherein each said elongated member includes an axially inwardly extending post hole and a post is frictionally disposed in each said post hole to interconnect said members.

7. The training aid of claim 6, wherein said post holes are coaxial such that when said members are connected by said post, said members are in co-alignment.

8. The training aid of claim 6, wherein said post holes are parallel to one another such that when said members are connected by said post, said members are parallel and out of co-alignment.

9. The training aid of claim 1, wherein said arched bottom surface extends less than 180 degrees about the handle.

10. The training aid of claim 9, wherein said arched bottom surface extends between about 90 and 180 degrees.

11. A training aid for aiding in training proper grip of a bat handle, which includes:

an elongated member including an outer portion and an inner core portion wherein said outer portion is of a generally translucent material and said inner core portion is of an opaque material having a unique color indicative of a particular size aid within a set of training aids, and wherein said member is characterized in cross section to include an arch of substantially same dimension throughout a longitudinal length of said member with an arched bottom surface complementary and for connection to a circumferential portion of the bat handle in a non-self retaining manner on the handle and has an arched outer surface which is of a size to extend along inside middle knuckles of one's fingers for purposes of providing knuckle alignment while permitting a substantial portion of one's fingers free to grip the bat handle and to provide a tactile sensation of gripping the bat principally with one's fingers and not one's palms and, which when so gripped by a batter, said training aid provides knuckle alignment for each hand and promotes anatomical superior fluidity of motion in one's hands, wrists and arms during a swing.

12. The training aid of claim 11, wherein said inner core portion is rigid relative to said outer portion to lend structural support to said training aid and wherein said outer portion is relatively pliable to enhance connection to the bat and comfort to grip the training aid.

13. A method of training a proper grip of a bat handle, which includes the steps of employing an elongated member having a cross section including an arch of substantially same dimension throughout a longitudinal length of said member with an arched bottom surface complementary and for connection to a circumferential portion of the bat handle in a non-self retaining manner on the handle and has an arched outer surface which is of a size to extend along inside middle knuckles of one's fingers for purposes of providing knuckle alignment while permitting a substantial portion of one's fingers free to grip the bat handle and to provide a tactile sensation of gripping the bat principally with one's fingers and not one's palms and, which when so gripped by a batter, said training aid provides knuckle alignment for each hand and promotes anatomical superior fluidity of motion in one's hands, wrists and arms during a swing, disposing said member onto the bat handle, and gripping about said member and the handle in a manner such that one's knuckles are disposed over said arched outer surface, wherein said training aid includes an outer portion and an inner core portion wherein said outer portion is of a generally translucent material and said inner core portion is of an opaque material having a unique color indicative of a particular size aid within a set of training aids.

14. The training aid of claim 13, wherein said inner core portion is rigid relative to said outer portion to lend structural support to said training aid and wherein said outer portion is relatively pliable to enhance connection to the bat and comfort to grip the training aid.

15. The training aid of claim 13, wherein said training aid includes an outer portion and an inner core portion wherein said inner core portion is rigid relative to said outer portion to lend structural support to said training aid and wherein said outer portion is relatively pliable to enhance connection to the bat and comfort to grip the training aid.

* * * * *